US010024340B2

(12) United States Patent
Yokota et al.

(10) Patent No.: US 10,024,340 B2
(45) Date of Patent: Jul. 17, 2018

(54) CYLINDER DEVICE WITH FORCE MULTIPLICATION MECHANISM

(71) Applicant: Kosmek Ltd., Hyogo (JP)

(72) Inventors: Hideaki Yokota, Hyogo (JP); Keitaro Yonezawa, Hyogo (JP)

(73) Assignee: KOSMEK LTD., Hyogo (JP)

( * ) Notice: Subject to any disclaimer, the term of this patent is extended or adjusted under 35 U.S.C. 154(b) by 469 days.

(21) Appl. No.: 14/430,247

(22) PCT Filed: Sep. 26, 2013

(86) PCT No.: PCT/JP2013/076120
§ 371 (c)(1),
(2) Date: Mar. 23, 2015

(87) PCT Pub. No.: WO2014/054503
PCT Pub. Date: Apr. 10, 2014

(65) Prior Publication Data

US 2015/0247512 A1 Sep. 3, 2015

(30) Foreign Application Priority Data

Oct. 1, 2012 (JP) ..... 2012-219707

(51) Int. Cl.
*F15B 15/16* (2006.01)
*F15B 11/036* (2006.01)
(Continued)

(52) U.S. Cl.
CPC ..... *F15B 11/036* (2013.01); *F15B 15/1409* (2013.01); *F15B 15/204* (2013.01); *F15B 2211/775* (2013.01)

(58) Field of Classification Search
CPC ..... F15B 2211/775; F15B 11/036; F15B 11/0365; F15B 11/046; F15B 11/028; F15B 15/204
(Continued)

(56) References Cited

U.S. PATENT DOCUMENTS 4,620,419 A * 11/1986 Simson ..... B30B 15/161 60/560
5,361,680 A 11/1994 Matsui
(Continued)

FOREIGN PATENT DOCUMENTS

JP 5430374 3/1979
JP 6267309 3/1987
(Continued)

OTHER PUBLICATIONS

European Search Report for application No. 3844228.0 dated Sep. 10, 2015.
(Continued)

*Primary Examiner* — Thomas E Lazo
*Assistant Examiner* — Dustin T Nguyen
(74) *Attorney, Agent, or Firm* — Bacon & Thomas, PLLC

(57) ABSTRACT

A first piston (4) which is coupled to an output rod (2) and which is inserted in a housing (3) is driven upward by a pressurized fluid. A second piston (6) which is arranged above the first piston (4) is driven downward. This causes a wedge-type force multiplier (M), arranged above the first piston (4), to carry out force multiplication driving with respect to the output rod (2).

5 Claims, 3 Drawing Sheets

(51) Int. Cl.
*F15B 15/14* (2006.01)
*F15B 15/20* (2006.01)

(58) Field of Classification Search
USPC ... 91/519, 170 R, 172, 189 R, 511, 512, 520
See application file for complete search history.

(56) References Cited

U.S. PATENT DOCUMENTS

| | | | | |
|---|---|---|---|---|
| 9,133,866 | B2 * | 9/2015 | Yokota | B25B 5/064 |
| 2013/0199366 | A1 | 8/2013 | Yokota | |

FOREIGN PATENT DOCUMENTS

| | | |
|---|---|---|
| JP | 1171903 | 12/1989 |
| JP | 642507 | 2/1994 |
| JP | 11166506 | 6/1999 |
| JP | 11173307 | 6/1999 |
| JP | 200125932 | 1/2001 |
| JP | 2002096231 | 4/2002 |
| JP | 2008116032 | 5/2008 |
| JP | 2009255219 | 11/2009 |
| JP | 4945681 | 6/2012 |
| JP | 2012112532 | 6/2012 |
| WO | 2012070189 | 5/2012 |

OTHER PUBLICATIONS

International Preliminary Report Report on patentability of PCT/JP2013/076120 dated Apr. 16, 2015.
International Search Report of PCT/JP2013/076120 dated Oct. 29, 2013.

* cited by examiner

CYLINDER DEVICE WITH FORCE MULTIPLICATION MECHANISM

TECHNICAL FIELD

The present invention relates to a cylinder device having a force multiplier.

BACKGROUND ART

Such a type of conventional cylinder device having a force multiplier is disclosed in Patent Literature 1 (Japanese Patent Application Publication, Tokukai, No. 2001-25932 A). The conventional technique is configured as follows:

A main piston is arranged in a right part of a housing, and a sub piston is arranged in a left part of the housing. A cylindrical hole of the sub piston is fitted to a piston rod of the main piston. A lever of a lever-type force multiplier is swingably supported in a space on a left outside of the sub piston. An input section, provided outside in a radial direction of the lever, is in contact with a left surface of an outer circumference part of the sub piston, and an output section, provided inside in the radial direction of the lever, is coupled to the piston rod of the main piston.

By supply of pressurized air into a drive chamber formed between the main piston and the sub piston, the sub piston, which is driven leftward, carries out force multiplication driving rightward with respect to the piston rod (and the main piston) via the lever.

Another type of cylinder device having a force multiplier is disclosed in Patent Literature 2 (Japanese Patent No. 4945681 B, the specification). The conventional technique is configured as follows:

An output rod is inserted in a housing so as to be movable vertically. In an upper part of the housing, a first piston is formed so as to be integrated with a central part in an axis direction of the output rod. A second piston inserted in a lower part of the housing is fitted on a lower half part of the output rod so as to be hermetically movable vertically. A lock chamber is arranged between the first piston and the second piston. A first release chamber is arranged above the first piston, and a second release chamber is arranged below the second piston. A wedge-type force multiplier is arranged in the second release chamber provided below the second piston.

CITATION LIST

Patent Literature 1

Japanese Patent Application Publication, Tokukai, No. 2001-25932 A (Publication Date: Jan. 30, 2001)

Patent Literature 2

Japanese Patent, No. 4945681 B, the specification (Publication Date: Jun. 6, 2012)

SUMMARY OF INVENTION

Technical Problem

The lever-type force multiplier disclosed in Patent Literature 1 is complicated in configuration and large in outside dimension. This causes a problem that a cylinder device having such a force multiplier is large-sized in whole.

The wedge-type force multiplier disclosed in Patent Literature 2 is simple in configuration and small in outside dimension. Therefore, it is possible to improve the problem with Patent Literature 1.

However, according to the configuration of Patent Literature 2, since the second piston is hermetically fitted on the lower half part of the output rod, an area of a pressure-receiving cross section of the first piston, which is driven upward by a pressurized fluid supplied in the lock chamber, is narrowed by an area of a cross section of the lower half part of the output rod.

Meanwhile, there is also a request to enlarge the area of the pressure-receiving cross section of the first piston so as to increase output of the first piston or a request to reduce an outer diameter of the housing while securing the output of the first piston.

Therefore, the invention of Patent Literature 2 leaves room for improvement in that the first piston is powerfully driven.

An object of the present invention is to provide a compact cylinder device having a force multiplier and to increase output of a first piston.

Solution to Problem

In order to attain the above object, a cylinder device having a force multiplier in accordance with the present invention is configured as follows, for example, as illustrated in FIGS. 1 through 2D or FIG. 3:

That is, the cylinder device is configured such that a wedge-type force multiplier M as defined herein has a tapered surface and is caused to carry out force multiplication driving with respect to an output rod 2 by (i) driving, with the use of a pressurized fluid, an pressure-receiving surface 5 of a first piston 4, 4A which is coupled to the output rod 2 and which is inserted in a housing 3, 3A and (ii) moving, to a first piston side, a second piston 6, 6A which is provided on an output rod side of the first piston 4, 4A, the pressure-receiving surface 5 being located on an opposite side of the output rod 2, the wedge-type force multiplier M being provided on the output rod side of the first piston 4, 4A.

Advantageous Effects of Invention

According to the above configuration, a pressure-receiving surface of the first piston which pressure-receiving surface is located on an opposite side of an output rod is not narrowed by a cross section of the output rod, unlike the conventional techniques. As a result, it is possible to increase output of the first piston. Furthermore, it is possible to reduce an outer diameter of a housing while securing the output of the first piston.

DESCRIPTION OF EMBODIMENTS

The following description will discuss, in detail, embodiments of the present invention.

Embodiment 1

(Configuration of Cylinder Device 1 Having Force Multiplier)

Figure 1:
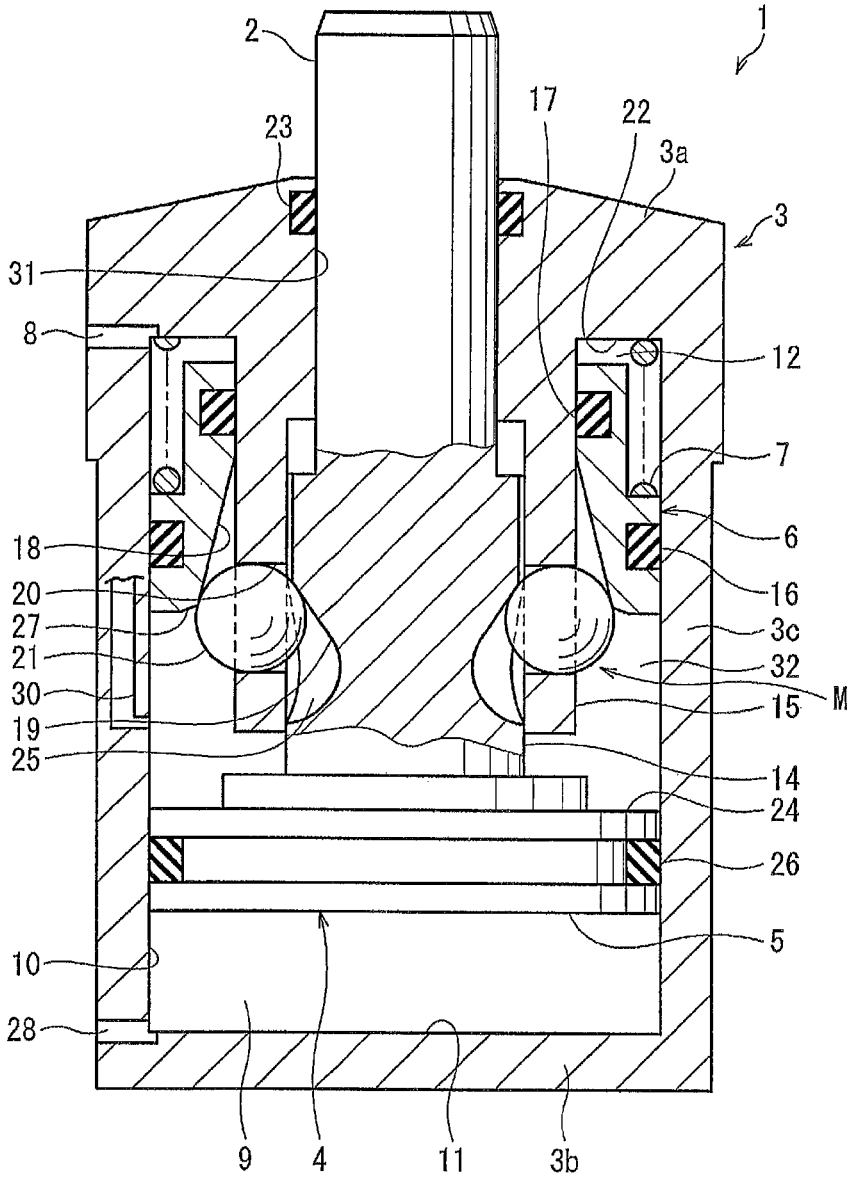
FIG. 1, which is equivalent to FIG. 2C, is a front cross-sectional view illustrating a cylinder device having a force multiplier in accordance with Embodiment 1 of the present invention.
Figure 2A:
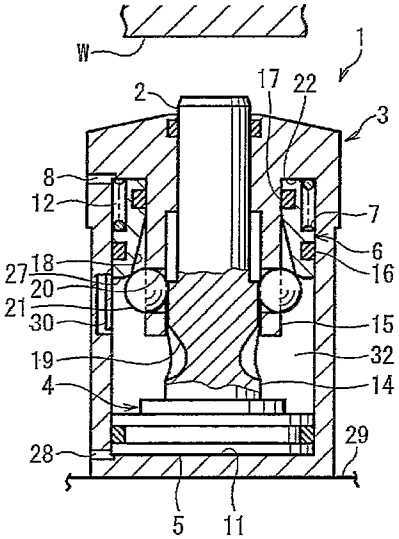
FIG. 2A through 2D are views each illustrating how the cylinder device having a force multiplier operates.
Figure 2B:
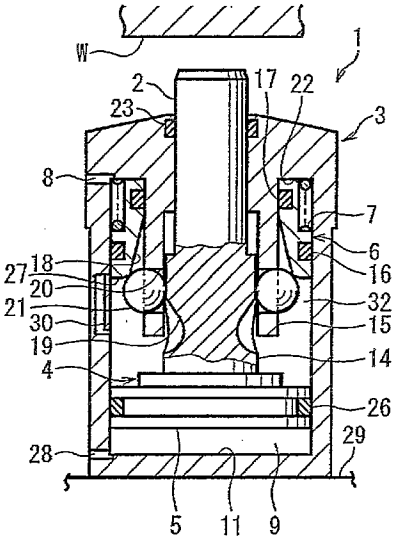
Figure 2C:
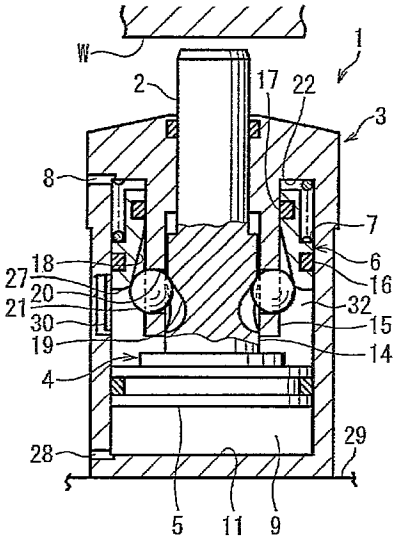

FIG. 1, which is equivalent to FIG. 2C, is a front cross-sectional view illustrating a configuration of a cylinder device 1 having a force multiplier in accordance with Embodiment 1.

The cylinder device 1 includes a housing 3 having a substantially cylindrical shape. The housing 3 has an upper end wall 3*a*, a lower end wall 3*b*, and a barrel part 3*c*.

The barrel part 3*c* of the housing 3 has, on its inner side, an inner circumferential surface 10. The lower end wall 3*b* of the housing 3 has, on its inner side, a lower end surface 11 having a circular shape. The upper end wall 3*a* of the housing 3 has a through-hole 31 formed so as to surround a central axis. A guide cylinder 15 integrally projects downward from a circumferential wall of the through-hole 31. The upper end wall 3*a* has, on its inner side, an upper end surface 22 having an annular shape which upper end surface 22 is located on an outer side of the guide cylinder 15.

An output rod 2 is inserted in the through-hole 31 via an upper sealing member 23 so as to be movable in a central axis direction. A lower end of the output rod 2 is coupled to a first piston 4. Note that FIG. 1 illustrates an example in which the output rod 2 and the first piston 4 are integrally formed. However, the output rod 2 and the first piston 4 can be formed individually and coupled to each other. As used in this specification, the term "couple" encompasses not only a configuration in which two members are formed individually and coupled to each other, but also a configuration in which two members are integrally formed.

The first piston 4 has (i) a circular plate part 24 which serves as a piston body and (ii) a cylinder part 14 which integrally projects upward from the circular plate part 24 and which serves as a piston rod. The circular plate part 24 is inserted in the inner circumferential surface 10 of the housing 3 via a lower sealing member 26 so as to be hermetically movable. The cylinder part 14 and the output rod 2 are integrally formed.

The circular plate part 24 has, on its lower side, a pressure-receiving surface 5, having a circular shape, which faces the lower end surface 11. The pressure-receiving surface 5 has a shape identical to a cross section of the housing 3.

A pressure chamber 9 is formed between the lower end wall 3*b* of the housing 3 and the pressure-receiving surface 5. A supply and discharge port 28, for supplying, into the pressure chamber 9, pressurized air which pressurizes the pressure-receiving surface 5, is formed between the barrel part 3*c* and the lower end wall 3*b*.

A second piston 6 having an annular shape is provided between the guide cylinder 15 and the barrel part 3*c*. The second piston 6 is provided so as to be movable, via an inner sealing member 17 and an outer sealing member 16, along an outer circumferential surface of the guide cylinder 15 and the inner circumferential surface 10 of the barrel part 3*c* of the housing 3. A force-multiplying surface 18 is formed by an inner circumferential surface of the second piston 6 so as to be away from an axis of an output rod 2 as it extends downward. The force-multiplying surface 18 has a press portion 27 on its lower part.

A drive chamber 12 for moving the second piston 6 downward is formed between the upper end wall 3*a* of the housing 3 and the second piston 6.

A spring 7 for moving the second piston 6 downward is mounted in the drive chamber 12.

A supply and discharge port 8 communicated with the drive chamber 12 is formed between the upper end wall 3*a* and the barrel part 3*c* of the housing 3. Pressurized air is supplied into and discharged from the drive chamber 12 via the supply and discharge port 8.

A release chamber 32 is formed between the first piston 4 and the second piston 6. Pressurized air is supplied into and discharged from the release chamber 32 via (i) a supply and discharge passage 30 formed in the barrel part 3*c* of the housing 3 and (ii) another supply and discharge port (not illustrated).

Four supporting holes 20 are formed in a circumferential direction at predetermined intervals in a lower part of a circumferential wall of the guide cylinder 15 so as to penetrate the circumferential wall in a radial direction. Engaging balls 21 are inserted in the respective supporting holes 20. Cam grooves 25 are formed in an outer circumferential surface of the cylinder part 14 of the first piston 4 so as to correspond to the respective engaging balls 21. Transmitting surfaces 19 formed by respective bottom walls of the cam grooves 25 are formed so as to become closer to the axis of the output rod 2 as they extend downward. That is, the transmitting surface 19 are formed so at to become smaller in diameter as they extend toward the pressure-receiving surface 5. The engaging balls 21 can be engaged with the transmitting surfaces 19.

A force multiplier M is constituted by the force-multiplying surface 18, the supporting holes 20, the engaging balls 21, and the transmitting surfaces 19. That is, the force multiplier M is arranged in the release chamber 32.

(Operation of Cylinder Device 1 Having Force Multiplier)

Figure 2D:
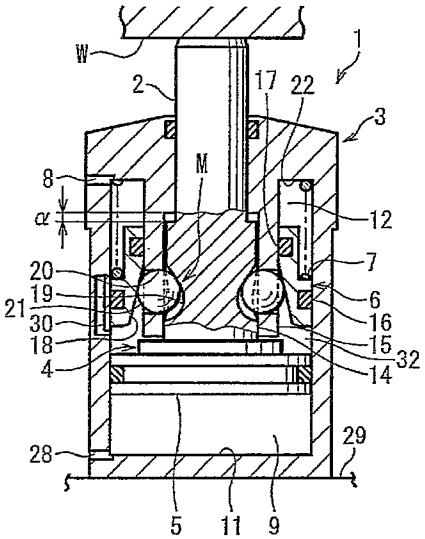

FIG. 2A is a front cross-sectional view illustrating how the cylinder device 1 having a force multiplier operates in a release state (return driving state). FIG. 2B is a front cross-sectional view illustrating how the cylinder device 1 operates in a final stage of a low-load stroke. FIG. 2C is a front cross-sectional view illustrating how the cylinder device 1 operates in an initial state of force multiplication driving. FIG. 2D is a front cross-sectional view illustrating how the cylinder device 1 operates in a lock state.

The housing 3 is fixed to a stationary member 29, such as a work pallet, with the use of a plurality of bolts (not illustrated).

In the release state (return driving state) illustrated in FIG. 2A, pressurized air is discharged from the pressure chamber 9 (see FIG. 2B), pressurized air is discharged from the drive chamber 12, and pressurized air is supplied into the release chamber 32. This causes (i) the first piston 4 to move downward and to be received by the lower end surface 11 and (ii) the second piston 6 to move upward and to be received by the upper end surface 22. Therefore, given gaps are formed between the press portion 27 of the second piston 6 and the engaging balls 21.

In a case where the cylinder device 1 having a force multiplier is subjected to lock driving, (i) the pressurized air is discharged from the release chamber 32 and (ii) pressurized air is supplied into each of the pressure chamber 9 and the drive chamber 12, in the release state illustrated in FIG. 2A.

In this state, the second piston 6 intends to move downward due to a biasing force of the spring 7 and a pressure of the pressurized air in the drive chamber 12. However, the outer circumferential surface of the cylinder part 14 of the first piston 4 pushes out the engaging balls 21 outward in a radial direction, and the press portion 27 of the second piston 6 is received by lower walls of the supporting holes 20 of the guide cylinder 15 via the engaging balls 21 (that is, the second piston 6 is coupled to the guide cylinder 15). Therefore, the second piston 6 is prevented from moving downward.

This causes the first piston 4 to move upward with a low load so as to become closer to a workpiece W (see FIG. 2B which illustrates the final stage of the low-load stroke). Specifically, a force, based on a pressure of the pressurized air in the pressure chamber 9 which pressurized air acts on the pressure-receiving surface 5, acts upward on the first piston 4. Since the press portion 27 of the second piston 6 pushes the engaging balls 21 toward the outer circumferential surface of the cylinder part 14, this pressing force serves sliding resistance to the first piston 4. Furthermore, sliding resistance from the upper sealing member 23 and the lower sealing member 26 also acts on the first piston 4. Therefore, the first piston 4 moves upward against the sliding resistance.

In the final stage of the low-load stroke illustrated in FIG. 2B, the engaging balls 21 are about to engage with the respective transmitting surfaces 19.

In a case where the first piston 4 moves upward a given stroke with a low load, the press portion 27 pushes out the engaging balls 21 toward the respective transmitting surfaces 19, so that force multiplication driving is started (see FIG. 2C which illustrates the initial state of the force multiplication driving). This causes the second piston 6 to be decoupled from the guide cylinder 15 (the housing 3) and causes the force-multiplying surface 18 of the second piston 6 to start strongly moving the first piston 4 upward via the engaging balls 21 and the transmitting surfaces 19. In this case, since the pressure of the pressurized air supplied in the pressure chamber 9 also acts on the first piston 4 via the pressure-receiving surface 5, the first piston 4 further strongly moves upward.

The first piston 4 further slightly moves upward, so that an upper end of the output rod 2 is in contact with the workpiece W and the workpiece W is pushed (see FIG. 2D which illustrates the lock state). In the lock state illustrated in FIG. 2D, there is a margin stroke a left above the cylinder part 14 of the first piston 4.

In the lock state, a resultant force of (i) a force acting from the second piston 6 on the first piston 4 via the force multiplier M and (ii) a pneumatic pressure acting on the pressure-receiving surface 5 of the first piston 4 acts upward. This causes the output rod 2 to strongly push the workpiece W.

In a case where the cylinder device 1 is switched from the lock state illustrated in FIG. 2D to the release state illustrated in FIG. 2A, (i) the pressurized air is discharged from each of the pressure chamber 9 and the drive chamber 12 and (ii) pressurized air is supplied into the release chamber 32, in the lock state illustrated in FIG. 2D. This causes the first piston 4 to move downward and causes the second piston 6 to move upward.

The transmitting surfaces 19 of the cylinder part 14 of the first piston 4 accordingly start pushing the respective engaging balls 21 outward in the radial direction (see FIG. 2C).

Then, the second piston 6 is prevented from moving upward by the upper end surface 22 of the housing 3 (see FIG. 2B). Almost simultaneously, the outer circumferential surface of the cylinder part 14 of the first piston 4 pushes out the engaging balls 21 outward in the radial direction. This causes the second piston 6 to be decoupled from the first piston 4 and to be received by the guide cylinder 15 via the engaging balls 21. As a result, the second piston 6 is prevented from moving downward.

Thereafter, the first piston 4 further moves downward with respect to the second piston 6, which is prevented from moving upward or downward (see FIG. 2A).

(Variations)

The foregoing cylinder device 1 having a force multiplier is configured such that the second piston 6 is biased downward by the spring 7 provided in the drive chamber 12 and is pressurized downward by pressurized air supplied in the drive chamber 12. However, the present invention is not limited to such a configuration.

That is, the cylinder device 1 can be configured such that the second piston 6 is moved downward merely by the spring 7 without supply of pressurized air in the drive chamber 12. In this case, the supply and discharge port 8 functions as a breathing hole. This makes it possible to move the second piston 6 to a first piston 4 side with a simpler configuration. Alternatively, the cylinder device 1 can be configured such that the second piston 6 is moved downward merely by pressurized air without provision of the spring 7 in the drive chamber 12. In this case, it is possible to independently control (i) pressurized air for moving the second piston 6 downward and (ii) pressurized air for moving the first piston 4 upward. Therefore, it is possible to minutely control a timing at which a low-load stroke is switched to a high-load stroke.

The cylinder device 1 is configured such that the second piston 6 is biased downward by the spring 7 provided in the drive chamber 12. Therefore, even in a case where a pressure in the drive chamber 12 is decreased or lost for some reason in the lock state illustrated in FIG. 2D, a biasing force of the spring 7 mechanically maintains the lock state via wedge action carried out by the force multiplier M (the force-multiplying surface 18, the supporting holes 20, the engaging balls 21, and the transmitting surfaces 19). This allows the lock state to be securely maintained.

Embodiment 1 has described an example in which the engaging balls 21 of the force multiplier M directly carries out the force multiplication driving with respect to the cylinder part 14 of the first piston 4 and indirectly carries out the force multiplication driving with respect to the output rod 2. However, the present invention is not limited to such a configuration. Alternatively, the engaging balls 21 can directly carry out the force multiplication driving with respect to the output rod 2.

(Effects)

As has been described, according to Embodiment 1, the first piston 4 is coupled to the output rod 2, and the second piston 6 and the wedge-type force multiplier M are provided on an output rod side of the first piston 4. Therefore, unlike the conventional techniques, the pressure-receiving surface 5 of the first piston 4, which pressure-receiving surface 5 is located on an opposite side of the output rod 2, is not narrowed by the output rod 2. This allows the pressure-receiving surface 5 of the first piston 4 to be large in area. Since this causes an increase in force based on a pressurized fluid which force acts on the pressure-receiving surface 5 of the first piston 4, it is possible to increase output of the first piston 4.

Furthermore, an area of the pressure-receiving surface 5 is equal to that of a cross section of the inner circumferential surface 10 of the housing 3. This allows the pressure-receiving surface 5 of the first piston 4 to be larger in area. Since this causes a further increase in force based on a pressurized fluid which force acts on the pressure-receiving surface 5 of the first piston 4, it is possible to increase output of the first piston 4.

Moreover, in the return driving state, the first piston 4 is received by the end surface 11, which faces the pressure-receiving surface 5 of the housing 3, and the second piston 6 is received by the end surface 22, which faces the second piston 6 of the housing 3. The first piston 4 and the second piston 6 are thus received by the end surfaces 11 and 22, respectively, of the housing 3. Therefore, it is not necessary to form, on the inner circumferential surface 10 of the housing 3, a stopper for receiving the first piston 4 and the second piston 6, unlike the conventional configuration disclosed in Patent Literature 2. This simplifies processing of the housing 3 and, accordingly, allows a reduction in cost of the cylinder device having a force multiplier.

Moreover, the first piston 4 has the cylinder part 14 formed on the output rod side. The guide cylinder 15, in which the cylinder part 14 is inserted, is formed on the hosing 3. The second piston 6 moves along the outer circumferential surface of the guide cylinder 15 and the inner circumferential surface 10 of the housing 3. The outer circumferential surface of the guide cylinder 15 and the inner circumferential surface 10 of the housing 3 are both fixed to the housing 3. It is therefore possible to more securely move the second piston 6.

Embodiment 2

(Configuration of Cylinder Device 1A Having a Force Multiplier)

Figure 3:
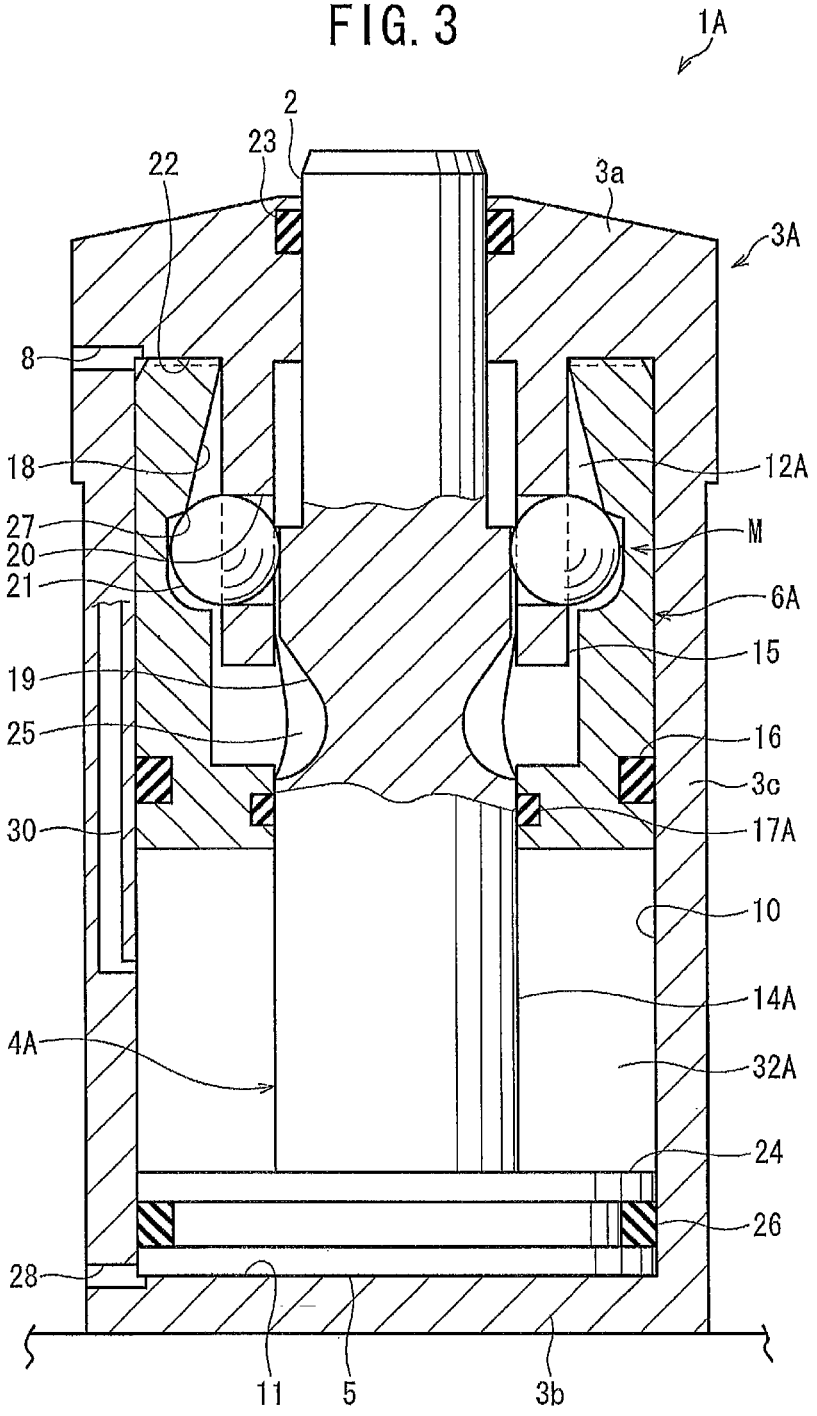
FIG. 3, which is similar to FIG. 1, is a view illustrating a cylinder device having a force multiplier in accordance with Embodiment 2.

FIG. 3 is a front cross-sectional view illustrating a configuration of a cylinder device 1A having a force multiplier in accordance with Embodiment 2. In Embodiment 2, identical reference numerals will be given to respective components which have been described in Embodiment 1, and the components will not be described in detail.

The cylinder device 1A includes a housing 3A. A first piston 4A has (i) a circular plate part 24 which is formed so as to be hermetically movable along an inner circumferential surface 10 of the housing 3A via a lower sealing member 26 and (ii) a cylinder part 14A which is formed so as to be integrated with an output rod 2 and which projects upward from the circular plate part 24.

A second piston 6A is provided between a guide cylinder 15 and a barrel part 3*c*. The second piston 6A is formed so as to be longer, in a vertical direction, than the guide cylinder 15. A lower end part of the second piston 6A is movable along an outer circumferential surface of the cylinder part 14A via an inner sealing member 17A and is movable along the inner circumferential surface 10 of the housing 3A via an outer sealing member 16.

In Embodiment 1, a force multiplier M including a force-multiplying surface 18, supporting holes 20, engaging balls 21, and transmitting surfaces 19 is arranged in a release chamber 32. However, in Embodiment 2, the force multiplier M is arranged in a drive chamber 12A (see FIG. 3).

(Operation of Cylinder Device 1A Having Force Multiplier)

The cylinder device 1A having a force multiplier also operates in a manner similar to that of the cylinder device 1 having a force multiplier described in Embodiment 1.

In a release state (return driving state) illustrated in FIG. 3, pressurized air is discharged from a pressure chamber (not illustrated), pressurized air is discharged from the drive chamber 12A, and pressurized air is supplied into a release chamber 32A. This causes (i) the first piston 4A to move downward and to be received by a lower end surface 11 and (ii) the second piston 6A to move upward and to be received by an upper end surface 22. Therefore, given gaps are formed between a press portion 27 of the second piston 6 and the engaging balls 21.

In a case where the cylinder device 1A having a force multiplier is subjected to lock driving, (i) the pressurized air is discharged from the release chamber 32A and (ii) pressurized air is supplied into each of the pressure chamber and the drive chamber 12A, in the release state illustrated in FIG. 3.

In this state, the second piston 6A intends to move downward due to a pressure of the pressurized air in the drive chamber 12A. However, the outer circumferential surface of the cylinder part 14A of the first piston 4A pushes out the engaging balls 21 outward in a radial direction of a cross section of the housing 3A, and the press portion 27 of the second piston 6A is received by lower walls of the supporting holes 20 of the guide cylinder 15 via the engaging balls 21 (that is, the second piston 6A is coupled to the guide cylinder 15). Therefore, the second piston 6A is prevented from moving downward.

This causes the first piston 4A to move upward with a low load so as to become closer to a workpiece. Then, in a final stage of a low-load stroke, the engaging balls 21 are about to engage with the respective transmitting surfaces 19.

In a case where the first piston 4A moves upward a given stroke with a low load, the cylinder device 1A gets into an initial state of force multiplication driving and the press portion 27 pushes out the engaging balls 21 toward the respective transmitting surfaces 19, so that the force multiplication driving is started. This causes the second piston 6A to be decoupled from the guide cylinder 15 (the housing 3) and causes the force-multiplying surface 18 of the second piston 6A to start strongly moving the first piston 4A upward via the engaging balls 21 and the transmitting surfaces 19. In this case, since the pressure of the pressurized air supplied in the pressure chamber also acts on the first piston 4A via a pressure-receiving surface 5, the first piston 4A further strongly moves upward.

Next, in a lock state, the first piston 4A further slightly moves upward, so that an upper end of the output rod 2 is in contact with the workpiece and the workpiece is pushed. In the lock state, a resultant force of (i) a force acting from the second piston 6A on the first piston 4A via the force multiplier M and (ii) a pneumatic pressure acting on the pressure-receiving surface 5 of the first piston 4A acts upward. This causes the output rod 2 to strongly push the workpiece.

The cylinder device 1A is switched from the lock state to the release state illustrated in FIG. 3 in a manner similar to that described in Embodiment 1.

(Variations)

In an example illustrated in FIG. 3, no spring is provided so as to move the second piston 6A downward. However, the present invention is not limited to such a configuration. Similar to Embodiment 1, a spring can be provided so as to move the second piston 6A downward. For example, a spring can be mounted between a lower end surface of the guide cylinder 15 and a lower part of the second piston 6A which lower part faces the lower end surface of the guide cylinder 15.

(Effects)

The first piston 4A has the cylinder part 14A formed on an output rod 2 side. The second piston 6A moves along the outer circumferential surface of the cylinder part 14A and the inner circumferential surface 10 of the housing 3A. This causes the second piston 6A to move along the outer circumferential surface of the cylinder part 14A located on an inner side of the guide cylinder 15. This allows a pressure-receiving surface on a release chamber 32A side of the second piston 6A to be larger in area. It is therefore possible to strongly move the second piston 6A by pressurized air.

Further, in the return driving state, the first piston 4A is received by the lower end surface 11, which faces the pressure-receiving surface 5 of the housing 3A, and the second piston 6A is received by the upper end surface 22, which faces the second piston 6A of the housing 3A. The first piston 4A and the second piston 6A are thus received by the lower end surface 11 and the upper end surface 22, respectively, of the housing 3A. Therefore, it is not necessary to form, on the inner circumferential surface of the housing, a stopper for receiving the first piston and the second piston, unlike the conventional configuration disclosed in Patent Literature 2. This simplifies processing of the housing and, accordingly, allows a reduction in cost of the cylinder device having a force multiplier.

The above embodiments or variations can be further altered as follows. The cylinder device 1 having a force multiplier can be placed in a manner different from that illustrated in the drawings. That is, the cylinder device 1 can be alternatively placed upside down, laid down, or placed obliquely. Further, a pressurized fluid used for the cylinder device 1 having a force multiplier can be a liquid such as pressurized oil, instead of pressurized air as has been described.

(Summary of the Present Invention)

Summary of the present invention is as follows.

That is, a cylinder device of the present invention is configured such that a wedge-type force multiplier M is caused to carry out force multiplication driving with respect to an output rod 2 by (i) driving, with the use of a pressurized fluid, an pressure-receiving surface 5 of a first piston 4, 4A which is coupled to the output rod 2 and which is inserted in a housing 3, 3A and (ii) moving, to a first piston side, a second piston 6, 6A which is provided on an output rod side of the first piston 4, 4A, the pressure-receiving surface 5 being located on an opposite side of the output rod 2, the wedge-type force multiplier M being provided on the output rod side of the first piston 4, 4A.

Therefore, according to the present invention, the pressure-receiving surface of the first piston, which pressure-receiving surface is located on an opposite side of the output rod, is not narrowed by the output rod, unlike the conventional techniques. This allows the pressure-receiving surface of the first piston to be large in area. Since this causes an increase in force based on a pressurized fluid which force acts on the pressure-receiving surface of the first piston, it is possible to increase output of the first piston.

The present invention is preferably arranged such that an area of the pressure-receiving surface 5 is equal to that of a cross section of an inner circumferential surface 10 of the housing 3, 3A. This configuration allows the pressure-receiving surface of the first piston to be larger in area. Since this causes a further increase in force based on a pressurized fluid which force acts on the pressure-receiving surface of the first piston, it is possible to increase output of the first piston.

The present invention is preferably arranged such that a spring 7 is provided for moving the second piston 6, 6A to the first piston side. This configuration simplifies a configuration which causes the second piston to move to the first piston side. Moreover, even in a case where a strong external force acts on the output rod, a biasing force of the spring is capable of maintaining the second piston and the first piston in a lock state via the wedge-type force multiplier.

The present invention is preferably arranged such that a supply and discharge port 8 is provided through which a pressurized fluid, for (i) moving the second piston 6, 6A to the first piston side and (ii) returning the second piston 6, 6A to an original position, is supplied and discharged. According to the above configuration, the supply and discharge port is provided through which a pressurized fluid, for (i) moving the second piston to the first piston side and (ii) returning the second piston (6, 6A) to an original position, is supplied and discharged. This makes it possible to independently control (i) a pressurized fluid for moving the second piston to the first piston side and (ii) a pressurized fluid for driving the pressure-receiving surface of the first piston. It is therefore possible to minutely control a timing at which each of the pistons is moved.

The present invention is preferably arranged such that: a spring 7 is provided for moving the second piston 6, 6A to the first piston side; and a supply and discharge port 8 is provided through which a pressurized fluid, for (i) moving the second piston 6, 6A to the first piston side and (ii) returning the second piston 6, 6A to an original position, is supplied and discharged. According to the above configuration, even in a case where supply of a pressurized fluid is slow or stopped, it is possible to move the second piston to the first piston side due to action of the spring, thereby carrying out the force multiplication driving with respect to the output rod. As a result, reliability of movement of the second piston is improved. Moreover, even in a case where a strong external force acts on the output rod, a biasing force of the spring is capable of maintaining the second piston and the first piston in a lock state via the wedge-type force multiplier.

The present invention is preferably arranged such that a pressure chamber 9, into which the pressurized fluid that drives the pressure-receiving surface 5 is supplied, is formed between (i) an end wall 3*b* on the first piston side, out of an end wall 3*a* and the end wall 3*b* of the housing 3, 3A, and (ii) the pressure-receiving surface 5. This configuration allows the pressure-receiving surface to be driven by a pressurized fluid with a simple configuration.

The present invention is preferably arranged such that a drive chamber 12, 12A, used to move the second piston 6, 6A to the first piston side, is formed between (i) an end wall 3*a* on the output rod side, out of the end wall 3*a* and an end wall 3*b* of the housing 3, 3A, and (ii) the second piston 6, 6A. According to the above configuration, it is possible to move the second piston to the first piston side with a simple configuration.

The present invention is preferably arranged such that, in a return driving state in which the first piston 4, 4A and the second piston 6, 6A are moved so as to be away from each other, the first piston 4, 4A is received by an end surface 11 of the housing 3, 3A which end surface 11 faces the pressure-receiving surface 5, whereas the second piston 6, 6A is received by an end surface 22 of the housing 3, 3A which end surface 22 faces the second piston 6, 6A. According to the above configuration, it is not necessary to form, on the inner circumferential surface of the housing, a stopper for receiving the first piston and the second piston, unlike the conventional configuration disclosed in Patent Literature 2. This simplifies processing of the housing and, accordingly, allows a reduction in cost of the cylinder device having a force multiplier.

For example, as illustrated in FIG. 1, the present invention is preferably arranged such that: the first piston 4 has a cylinder part 14 formed on the output rod side; a guide cylinder 15 in which the cylinder part 14 is inserted is formed on the housing 3; and the second piston 6 moves along an outer circumferential surface of the guide cylinder 15 and an inner circumferential surface 10 of the housing 3. According to the above configuration, the outer circumferential surface of the guide cylinder and the inner circumferential surface of the housing are both fixed to the housing. It is therefore possible to more securely move the second piston.

For example, as illustrated in FIG. 3, the present invention is preferably arranged such that: the first piston 4A has a cylinder part 14A formed on the output rod side; and the second piston 6A moves along an outer circumferential surface of the cylinder part 14A and an inner circumferential surface 10 of the housing 3A. According to the above configuration, the second piston moves along the outer circumferential surface of the cylinder part located on an inner side of the guide cylinder. This allows a pressure-receiving surface on a release chamber side of the second piston to be larger in area. It is therefore possible to strongly move the second piston by a pressurized fluid.

The present invention is preferably arranged such that: the first piston 4, 4A has a cylinder part 14, 14A formed on the output rod side; and the wedge-type force multiplier M includes: a force-multiplying surface 18 formed on the second piston 6, 6A so as to be away from an axis of the output rod 2 as the force-multiplying surface extends toward the pressure-receiving surface 5; a transmitting surface 19 formed on the cylinder part 14, 14A so as to become closer to the axis of the output rod 2 as the transmitting surface 19 extends toward the pressure-receiving surface 5; a supporting hole 20 formed in a guide cylinder 15 which is formed on the housing 3, 3A so that the cylinder part 14, 14A is inserted in the guide cylinder 15; and an engaging ball 21 inserted in the supporting hole 20, the engaging ball 21 carrying out force multiplication driving with respect to the transmitting surface 19 by being pushed by the force-multiplying surface 18. This simplifies a configuration in which the wedge-type force multiplier is arranged on a rod side of the first piston.

The present invention is preferably arranged such that: the wedge-type force multiplier M includes a plurality of engaging balls 21 which are mounted between the second piston 6, 6A and any one of the first piston 4, 4A and the output rod 2 and which are arranged in a circumferential direction around an axis of the first piston 4, 4A at predetermined intervals; and the plurality of engaging balls 21 switches between a first state and a second state, the first state being a state where (i) the second piston 6, 6A is prevented from moving to the first piston 4, 4A side and (ii) the first piston 4, 4A and the output rod 2 are moved to a second piston 6, 6A side, the second state being a state where (I) the second piston 6, 6A is moved to the first piston 4, 4A side and (II) the second piston 6, 6A carries out force multiplication driving so that the first piston 4, 4A and the output rod 2 are moved to the second piston 6, 6A side. According to the above configuration, it is possible to securely and smoothly switch between (i) a state where the force multiplication driving is carried out and (ii) a state where the force multiplication driving is not carried out.

The present invention is not limited to the description of the embodiments, but may be altered by a skilled person in the art within the scope of the claims. An embodiment derived from a proper combination of technical means disclosed in different embodiments is also encompassed in the technical scope of the present invention.

REFERENCE SIGNS LIST

1, 1A Cylinder device having force multiplier
2 Output rod
3, 3A Housing
3*a* Upper end wall (end wall on output rod side)
3*b* Lower end wall (end wall on first piston side)
4, 4A First piston
5 Pressure-receiving surface
6, 6A Second piston
7 Spring
8 Supply and discharge port
9 Pressure chamber
10 Inner circumferential surface
11 Lower end surface (end surface)
12, 12A Drive chamber
14, 14A Cylinder part
18 Force-multiplying surface
19 Transmitting surface
20 Supporting hole
21 Engaging ball
22 Upper end surface (end surface)
M Wedge-type force multiplier

The invention claimed is:

1. A cylinder device having a force multiplier, wherein the force multiplier (M) comprises a tapered surface, wherein the tapered surface carries out force multiplication driving with respect to an output rod (2) that is attached to a first surface of a first piston, wherein the first piston is driven with the use of a pressurized fluid acting against a pressure-receiving surface (5) on the first piston (4, 4A) located on a side opposite the first surface, wherein the output rod (2) extends through a guide cylinder that is formed integrally inside a housing, wherein a drive chamber is formed between a wall of said housing and the guide cylinder, wherein said tapered surface is formed on a second piston located in said drive chamber, and wherein the force multiplication driving is carried out when the tapered surface on the second piston engages with balls located in the guide cylinder which causes the balls to engage with cam grooves in the output rod.

2. The cylinder device having the force multiplier as set forth in claim 1, wherein an area of the pressure-receiving surface (5) is equal to that of a cross section of an inner circumferential surface (10) of the housing (3, 3A).

3. The cylinder device having the force multiplier as set forth in claim 1, wherein a spring (7) is provided for moving the second piston (6, 6A) to engage the balls in the guide cylinder.

4. The cylinder device having the force multiplier as set forth in claim 1, wherein the second piston (6, 6A) is moved to engage the balls by discharging a pressurized fluid through a supply and discharge passage (30) from a release chamber formed by the first and second pistons and supplying a pressurized fluid through a supply and discharge port (8) to the drive chamber; and the second piston (6, 6A) is returned to an original position by discharging the pressurized fluid through the supply and discharge port (8) and supplying the pressurized fluid through the supply and discharge passage (30).

5. The cylinder device having the force multiplier as set forth in claim 1, wherein:

by discharging a pressurized fluid from a release chamber formed by the first and second pistons through a supply and discharge passage (30) and supplying a pressurized fluid through a supply and discharge port (8) to the drive chamber being formed by the second piston and a side wall of the housing, the second piston (6, 6A) is moved to engage the balls in the guide cylinder by the pressurized fluid, supplied through the supply and discharge port (8), and a spring (7) in the drive chamber; and the second piston (6, 6A) is returned to an original position by discharging the pressurized fluid through the supply and discharge port (8) of the drive chamber and supplying the pressurized fluid through the supply and discharge passage (30) of the release chamber.

* * * * *